United States Patent [19]

Fähnrich

[11] Patent Number: 4,461,982

[45] Date of Patent: Jul. 24, 1984

[54] HIGH-PRESSURE METAL VAPOR DISCHARGE LAMP IGNITER CIRCUIT SYSTEM

[75] Inventor: Hans-Jürgen Fähnrich, Munich, Fed. Rep. of Germany

[73] Assignee: Patent-Treuhand Gesellschaft für elektrische Gluhlampen mbH, Munich, Fed. Rep. of Germany

[21] Appl. No.: 350,046

[22] Filed: Feb. 18, 1982

[30] Foreign Application Priority Data

Mar. 6, 1981 [DE] Fed. Rep. of Germany ..... 3108547

[51] Int. Cl.[3] ..... H05B 37/00

[52] U.S. Cl. ..... 315/290; 315/176; 315/276; 315/289; 315/DIG. 7

[58] Field of Search ..... 315/176, 276, 283, DIG. 7, 315/289, 290

[56] References Cited

U.S. PATENT DOCUMENTS

| | | | |
|---|---|---|---|
| 3,681,653 | 8/1972 | Snyder | 315/176 |
| 4,275,337 | 6/1981 | Knoble et al. | 315/DIG. 7 |
| 4,342,948 | 8/1982 | Samuels | 315/289 |

*Primary Examiner*—Harold Dixon

*Attorney, Agent, or Firm*—Frishauf, Holtz, Goodman & Wooward

[57] ABSTRACT

To insure reliable starting, a superposition igniter circuit utilizes an auxiliary capacitor (10) which has a resistor (6) connected in parallel thereto. This parallel arrangement is serially connected with a pulse capacitor (7) and a choke (2) to form therewith a series oscillatory circuit which is connected directly with the primary winding (8, 13) of the pulse transformer (4, 11) in order to raise the lamp voltage during ignition. The parallel connection of the auxiliary capacitor (10) and the resistor (6) forms a load impedance for the pulse capacitor (7); the series circuit of the auxiliary capacitor (10) and the pulse capacitor (7) form a high-frequency short-circuit capacitor system. A voltage-sensitive semiconductor switch (9), such as a four-layer diode or a triac, disconnects the auxiliary capacitor (10) after lamp ignition, thus interrupting the series auxiliary circuit, permitting only normal supply voltage to be applied to the lamp (1).

8 Claims, 2 Drawing Figures

HIGH-PRESSURE METAL VAPOR DISCHARGE LAMP IGNITER CIRCUIT SYSTEM

Figure 1:
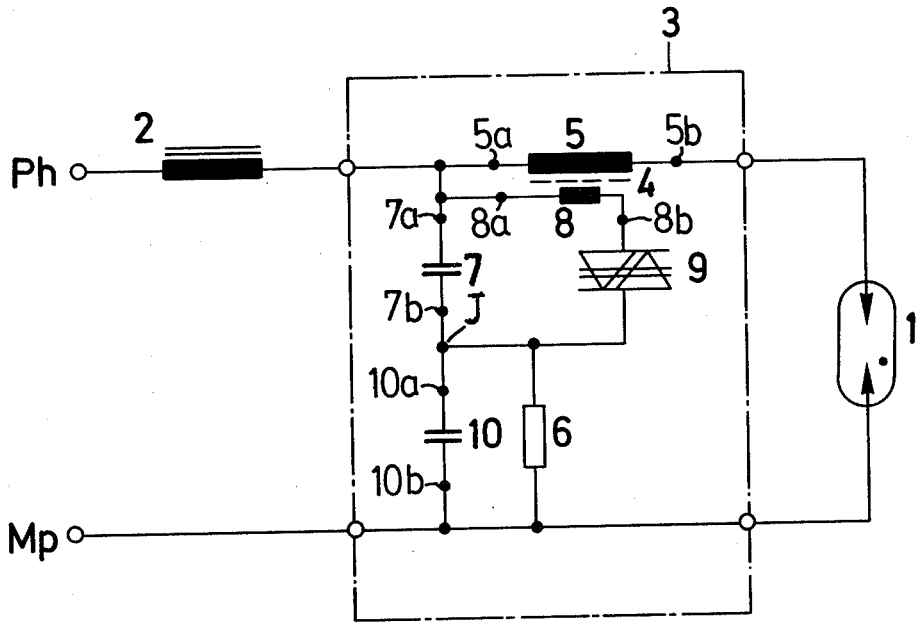

The present invention relates to an igniter circuit for a high-pressure metal vapor discharge lamp in which a pulse transformer is used to provide an igniter pulse.

BACKGROUND

Cold high-pressure metal vapor discharge lamps, such as sodium or halogen metal vapor high-pressure lamps, utilize igniter circuits in which pulses of electrical energy are superimposed above each other. Similar circuits can be used to re-ignite already warm lamps of this type. An auxiliary igniter capacitor is provided which is serially connected with a damping resistor. Small lamps, that is, lamps having power acceptance of up to about 400 W, can be operated without such damping resistors, if the inductance of the secondary of the pulse transformer is sufficient to limit the capacitor current, upon ignition of the lamp, to a suitable value.

An auxiliary series circuit can be connected by a relay contact, either manually operated or controlled by a starter or accessory unit when ignition is intended. Such igniter circuits are comparatively complex, expensive to manufacture, and are sensitive to temperature changes. They are subject to malfunction, and the power carrying terminals, especially, are sources of trouble.

Igniter circuits have been proposed in which, after ignition, further igniter pulses are suppressed by a semiconductor circuit. Such lamps, however, do not ignite reliably. This is particularly the case with respect to some lamps which have inherent ignition difficulties.

Igniter circuits have also been proposed in which audio frequency oscillations are generated to facilitate ignition—see, for example, German Pat. No. 1,589,306 (particularly FIGS. 3 and 4). These circuits have advantages, but have not been used commercially since some difficulties have been experienced. The circuits could not maintain the required operating range for reliable automatic ignition between about 160 and 198 V, especially in units made under mass production conditions. The phase position of the ignition pulses between 60°-el and 90°-el of the power frequency half-wave (50 or 60 Hz, as customarily used) required for reliable ignition could not be maintained.

THE INVENTION

It is an object to provide an automatic superposed pulse ignited circuit system in which the ignition connection and ignition-off voltages, as well as the phase position of the igniter pulses, are within the required narrow range, and which provide for reliable ignition of all lamps, even those which ignite with difficulty, whether they are cold or already warm. As an additional object, the network material requirements should be low, so that the cost of the igniter system can likewise be held at a low level.

Briefly, a pulse transformer is used in combination with a pulse capacitor; in accordance with the invention, a resistor is connected across an auxiliary capacitor to control, simultaneously, the ignition voltage range of the lamp and, further, the phase position of the ignition pulse generated by an oscillatory circuit which includes the pulse transformer.

Connecting the resistor in parallel with the auxiliary ignition capacitor insures correct phase position of the ignition pulses. The resistor acts both as a discharge resistor for the additional or auxiliary capacitor as well as a charge resistor for the pulse capacitor. The portion of the circuit which is turned off after ignition of the lamp includes a symmetrically switching semiconductor having a predetermined switching voltage, for example a suitably controlled triac or a four-layer diode.

The system has the advantage that all types of lamps, even those which are difficult to start, and whether cold or warm, are ignited reliably and rapidly. The inductive accessory unit having a series resonance circuit reduces the component requirement for the pulse superposition circuitry and prevents a pause without current since currents from a choke and the auxiliary capacitor will support each other and superimpose. Use of a symmetrically switching semiconductor element permits operation of the system, and hence generation of ignition pulses, during each half wave of the network power supply. The resistor, in parallel with the auxiliary capacitor, and forming simultaneously the charge resistor for the pulse capacitor, as an additional component, is a small unit which results in a compact igniter circuit system. It acts, also, as a portion of the high-frequency circuit. At high idling voltage, several pulses with short pulse repetition rate can be obtained during ignition phase, thus further insuring reliability of ignition of the lamp.

DRAWINGS

Figure 2:
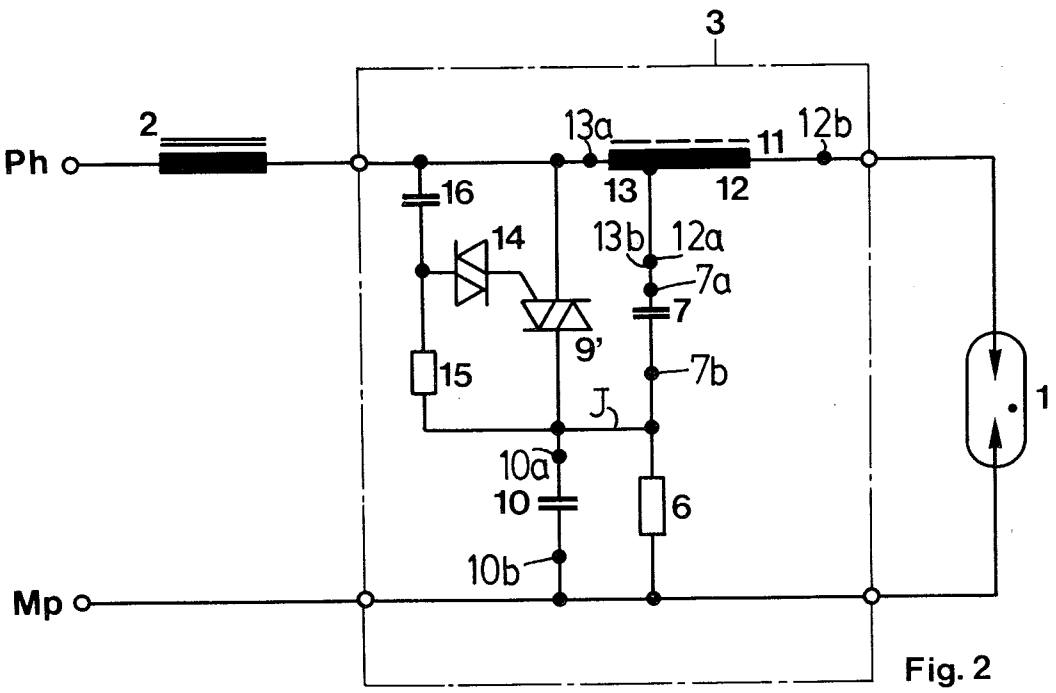

FIG. 1 is a general circuit diagram of the ignition system, illustrating the principle thereof; and FIG. 2 illustrates a similar system, utilizing an auto transformer.

The high-pressure metal vapor discharge lamp 1 is connected to the output of power supply having a phase terminal Ph and a reference or base or ground terminal Mp. Power supply is at standard power frequency, for example 50 or 60 Hz. The supply is connected through a choke 2 to the input of the igniter circuit 3. The circuit within the igniter circuit unit 3, essentially, includes a pulse transformer 4 which has a primary winding 8 having first and second terminals 8*a* and 8*b* and a secondary winding 5 having terminals 5*a* and 5*b*. The secondary winding 5 is connected in the phase line Ph, that is, between one lamp terminal and the choke 2. The series circuit of the secondary 5 of the transformer 4 and the lamp 1 have connected in parallel thereto a pulse capacitor 7 having first and second terminals 7*a*, 7*b* and, serially therewith, an auxiliary capacitor 10, having first and second terminals 10*a*, 10*b*. Capacitors 7, 10 thus form a capacitative voltage divider with a common junction J. A resistor 6 is connected in parallel with the auxiliary capacitor 10 between junction J and the ground terminal Mp. The primary 8 of the pulse transformer 4, serially connected to a four-layer diode 9, is connected across the pulse capacitor 7 or, in other words, to the tap point J of the voltage divider. The high-frequency circuit is completed by the series connection of the pulse capacitor 7, junction J, and the auxiliary ignition capacitor 10. The auxiliary capacitor 10, preferably, is large with respect to pulse capacitor 7, e.g. of about 3 times the capacity of capacitor 7.

OPERATION

Upon connection of the terminals Ph, Mp to a suitable source of voltage, capacitor 7 is charged over the parallel connection of the auxiliary capcitor 10 and resistor 6. When the charge voltage has reached a value which exceeds the breakdown voltage of the four-layer diode 9 which forms a voltage-controlled switch, the four-layer diode 9 becomes conductive and will have, effectively, zero resistance. The pulse capacitor 7 thus will discharge rapidly through the primary winding 8 of the pulse transformer 4. The voltage across the primary winding 8 is transformed upwardly by the pulse transformer 4, furnishing a high-voltage pulse of between about 2 kV to about 5 kV, in dependence on the transformation ratio of the pulse transformer, to apply the high voltage to the lamp 1. Simultaneously, and while the four-layer diode 9 is still conductive, an oscillatory circuit is formed by the choke 2 and the auxiliary capacitor 10 through conductive switch 9. The frequency of oscillation will be between about 500 to about 2000 Hz. The auxiliary capacitor 10 will thus apply a pulse over the secondary winding 5 so that a heightened voltage is applied to the secondary 5 of the pulse transformer 4 which insures ignition of lamps which, otherwise, are difficult to ignite or to start.

After the pulse capacitor 7 has discharged, and the voltage thereacross has dropped below the switching voltage of the four-layer diode 9, the four-layer diode 9 will block. Upon blocking, and reversal of direction of current flow, the series circuit formed by the choke 2 and the auxiliary capacitor 10 likewise is interrupted. In the meanwhile, however, the pulse capacitor 7, during the course of the oscillation, again receives a voltage thereacross and charge through resistor 6 which will, in due course, reach the breakdown voltage of the four-layer diode 9 which, again, will become conductive. This sequence will occur, within any one starting event, about two to six times. Consequently, pulses will recur spaced from each other by between 0.1 to about 0.5 milliseconds. These are all ignition pulses, following each other rapidly at voltage levels in excess of supply voltage. The rapid sequence of these pulses insures ignition of lamps which, otherwise, are difficult to ignite.

During ignition, the lamp will have a voltage of about between 400 to 500 V. The currents through the choke 2 and the auxiliary capacitor 10 superimpose at the instant of lamp ignition. The system, thus, avoids the pause in current flow which occurs in ignition systems of different type. The lamp, thus, will not have the tendency to extinguish immediately after having fired or started. After ignition, only the lamp operating voltage will be on the system. The four-layer diode 9 becomes non-conductive and disconnects the auxiliary capacitor 10, thus rendering the entire ignition system inactive. The high-frequency short-circuiting capacitor system, formed by the series circuitry of the pulse capacitor 7 and the auxiliary capacitor 10, provides for short-circuiting of pulses and ignition voltage peaks with respect to the power network, thus isolating peak voltages from the power network terminals Ph, Mp.

The circuit of FIG. 2 is similar to that described, except that the transformer 11 is an auto transformer, having a secondary 12 having first and second terminals 12*a*, 12*b* and a primary 13 having first and second terminals 13*a*, 13*b*. All other components are similar to those previously described and can be of the same structure and essentially the same values.

In one operating example, for a supply voltage between the terminals Ph, Mp of 220 V, at a frequency of 50 Hz, a capacitor 7 of 0.047 μF is suitable, in circuit with a capacitor 10 of 0.15 μF, and a resistor 6 of 33,000 ohms. The impedance of the choke, suitably, is 187 ohms.

Various changes and modifications may be made within the scope of the inventive concept. For example, the four-layer diode 9 can be replaced by a triac 9' (FIG. 2), with the gate suitably connected to a voltage control, for example to a diac 14 which is connected to a voltage divider consisting of resistor 15 and capacitor 16.

For other voltage and power ranges, the value of the resistor 6 should be so selected that the pulse capacitor 7 will charge sufficiently rapidly without, however, excessively loading the oscillatory circuit which is formed when the switch 9 breaks down. A value which provides a charge of capacitor 7 for breakdown of the switch 9 at about 70 degree-el. of a voltage half-wave is suitable although a later breakdown point is also acceptable.

I claim:

1. High-pressure metal vapor lamp ignition circuit system for starting of a high-pressure metal vapor discharge lamp (1) having electrical current supply terminals (Ph, Mp), said circuit system including a ballast choke (2);

a pulse transformer (4) having a primary (8) and a secondary (5) winding, one terminal (5*a*) of the primary winding being connected to one electrical current supply terminal (Ph);

the ballast choke, the secondary winding (5) of the pulse transformer (4) and the lamp (1) being connected in the first series circuit, which series circuit is connected across said supply terminals (Ph, Mp);

a pulse capacitor (7) having first and second capacitor terminals (7*a*, 7*b*), the first capacitor terminal (7*a*) being connected to one terminal (8*a*) of the primary winding (8) of the pulse transformer (4) and to the terminal of the choke (2) remote from its connection to the current supply terminal;

and an auxiliary capacitor (10) having first and second auxiliary capacitor terminals (10*a*, 10*b*), wherein the second capacitor terminal (7*b*) and the first auxiliary capacitor terminal (10*a*) are connected at a common junction (J) to form a capacitative series circuit defining a voltage divider in which said common junction forms a voltage divider tap, the second auxiliary capacitor terminal (10*b*) being connected to that one of the supply terminals (Mp) which is remote from the ballast choke (2) to thereby connect the capacitative series circuit defining the voltage divider in shunt, across the lamp (1) and form with said choke (2) an oscillatory circuit and, with said pulse transformer (4), an igniter or starting high-voltage superposition circuit for said lamp; wherein a voltage controlled switch (9) is provided, which becomes conductive when voltage in excess of a predetermined value is applied across the terminals of the voltage controlled switch, said voltage controlled switch being connected in a series starting circuit defined by:

the primary (8) of the pulse transformer—the terminals of the switch—said common junction (J) and hence to the tap of said capacitative voltage divider—the pulse capacitor (7); wherein a resistor (6) is provided, connected across the auxiliary capacitor (10) to provide for charging of the pulse capacitor (7)

while the voltage controlled switch (9) is initially non-conductive, through said resistor (6) and, upon conduction of the voltage controlled switch when the voltage across the pulse capacitor (7) reaches said predetermined value, providing a lamp ignition pulse through the pulse transformer (4, 11) and maintain oscillations in the oscillatory circuit formed by the choke (2) and the auxiliary capacitor (10) and the conductive switch (9) to provide additional energy for the firing pulse;

and wherein the respective values of the resistor (6) and the capacitor (7) and the predetermined value of conduction of said voltage controlled switch (9) are selected to provide an R/C time constant for switch-over to conduction of said voltage controlled switch at a predetermined phase angle of the supply voltage.

2. System according to claim 1, wherein said voltage controlled switch (9) comprises a voltage-responsive semiconductor element.

3. System according to claim 1, wherein the value of said resistor (6) is selected, with respect to the capacity of the pulse capacitor (7) to provide for charging of the pulse capacitor (7) therethrough within the rising portion of any voltage half-wave of the supply source.

4. System according to claim 1, wherein the value of said resistor (6) is selected, with respect to the capacity of the pulse capacitor (7) to provide for charging of the pulse capacitor (7) therethrough within the rising portion of any voltage half-wave of the supply source, and recharge of the pulse capacitor (7) after discharge and during subsequent non-conduction of the voltage controlled switch (9) within said voltage half-wave of the supply source.

5. System according to claim 4, wherein the capacitance of said auxiliary capacitor (10) is large with respect to the capacity of the pulse capacitor (7).

6. System according to claim 1, wherein the value of said resistor (6) is selected, with respect to the capacity of the pulse capacitor (7) to provide for charging of the pulse capacitor (7) therethrough within the rising portion of any voltage half-wave of the supply source, and recharge of the pulse capacitor (7) after discharge and during subsequent non-conduction of the voltage controlled switch (9) within said voltage half-wave of the supply source.

7. System according to claim 6, wherein the capacitance of said auxiliary capacitor (10) is large with respect to the capacitor of the pulse capacitor (7).

8. High-pressure metal vapor lamp ignition circuit system for starting of a high-pressure metal vapor discharge lamp (1) having electrical current supply terminals (Ph, Mp), said circuit system including a ballast choke (2);

a pulse transformer (11) having a primary (13) and a secondary (12) winding, one terminal (13*a*, 13) of the primary winding being connected to one electrical current supply terminal (Ph);

the ballast choke, the secondary winding (12) of the pulse transformer (11) and the lamp (1) being connected in the first series circuit, which series circuit is connected across said supply terminals (Ph, Mp);

a pulse capacitor (7) having first and second capacitor terminals (7*a*, 7*b*), the first capacitor terminal (7*a*) being connected to one terminal (13*b*) of the primary winding (13) of the pulse transformer (11) and to the terminal (12*b*) of the primary winding remote from said one terminal (13*a*) thereof to be energized by current flow through said primary winding;

and an auxiliary capacitor (10) having first and second auxiliary capacitor terminals (10*a*, 10*b*), wherein the second capacitor terminal (7*b*) and the first auxiliary capacitor terminal (10*a*) are connected at a common junction (J) to form a capacitative series circuit defining a voltage divider in which said common junction forms a voltage divider tap, the second auxiliary capacitor terminal (10*b*) being connected to that one of the supply terminals (Mp) which is remote from the ballast choke (2) to thereby connect the capacitative series circuit defining the voltage divider in shunt, across the lamp (1) and form with said choke (2) an oscillatory circuit and, with said pulse transformer (4, 11), an igniter or starting high-voltage superposition circuit for said lamp; wherein a voltage controlled switch (9) is provided, which becomes conductive when voltage in excess of a predetermined value is applied across the terminals of the voltage controlled switch, said voltage controlled switch being connected in a series starting circuit defined by:

the primary (8, 13) of the pulse transformer—the terminals of the switch—said common junction (J) and hence to the tap of said capacitance voltage divider—the pulse capacitor (7); wherein a resistor (6) is provided, connected across the auxiliary capacitor (10) to provide for charging of the pulse capacitor (7) while the voltage controlled switch (9, 9') is initially non-conductive, through said resistor (6) and, upon conduction of the voltage controlled switch when the voltage across the pulse capacitor (7) reaches said predetermined value, providing a lamp ignition pulse through the pulse transformer (4, 11) and maintain oscillations in the oscillatory circuit formed by the choke (2) and the auxiliary capacitor (10) and the conductive switch (9, 9') to provide additional energy for the firing pulse;

and wherein the respective values of the resistor (6) and the capacitor (7) and the predetermined value of conduction of said voltage controlled switch (9, 9') are selected to provide an R/C time constant for switch-over to conduction of said voltage controlled switch at a predetermined phase angle of the supply voltage.

* * * * *